US009890602B2

(12) United States Patent
Guttormsen et al.

(10) Patent No.: US 9,890,602 B2
(45) Date of Patent: Feb. 13, 2018

(54) WELL RUNNER

(71) Applicant: Halliburton Energy Services, Inc., Houston, TX (US)

(72) Inventors: Petter Guttormsen, Sandnes (NO); Jan Ellingsen, Hafrsfjord (NO); Christophe Tarayre, Vestre Åmøy (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 289 days.

(21) Appl. No.: 14/443,215

(22) PCT Filed: Nov. 26, 2012

(86) PCT No.: PCT/NO2012/050235

§ 371 (c)(1),
(2) Date: May 15, 2015

(87) PCT Pub. No.: WO2014/081305

PCT Pub. Date: May 30, 2014

(65) Prior Publication Data

US 2015/0300113 A1 Oct. 22, 2015

(51) Int. Cl.

| | |
|---|---|
| ***E21B 23/00*** | (2006.01) |
| ***E21B 23/14*** | (2006.01) |
| ***E21B 4/18*** | (2006.01) |

(52) U.S. Cl.

CPC ..... *E21B 23/00* (2013.01); *E21B 4/18* (2013.01); *E21B 23/14* (2013.01); *E21B 2023/008* (2013.01)

(58) Field of Classification Search

CPC .... E21B 2023/008; E21B 23/00; E21B 23/14; E21B 4/18

See application file for complete search history.

(56) References Cited

U.S. PATENT DOCUMENTS 5,184,676 A * 2/1993 Graham ..... E21B 4/18 166/104
2002/0190682 A1 12/2002 Schempf et al.
(Continued)

FOREIGN PATENT DOCUMENTS

CN 1605709 A 4/2005
CN 2806749 Y 8/2006
(Continued)

OTHER PUBLICATIONS

European Patent Office, Supplementary European Search Report, dated Sep. 1, 2016, 7 pages, European.
(Continued)

*Primary Examiner* — Brad Harcourt

(57) ABSTRACT

A drive module for a borehole or well tractor or runner comprises a drive module housing and a hydraulically actuated and pivoting drive arm comprising an arm housing and a drive wheel arranged thereto, wherein the drive wheel is driven by a motor mounted outside the drive arm housing and arranged along and parallel with the drive arm in resting position and onto or into the drive module wall for the cavity arranged or provided for the drive arm, and wherein the drive wheel is drivingly connected to the motor via a drive line arrangement, i.e. via a belt or chain drive arrangement and further via an angular gear or gearing arrangement mounted outside the drive arm housing. A borehole or well tractor or runner comprises at least one of said drive modules.

18 Claims, 6 Drawing Sheets

(56) References Cited

U.S. PATENT DOCUMENTS

| | | | |
|---|---|---|---|
| 2005/0145415 | A1 | 7/2005 | Doering et al. |
| 2010/0263856 | A1 | 10/2010 | Lynde |

FOREIGN PATENT DOCUMENTS

| | | | |
|---|---|---|---|
| CN | 202249866 | U | 5/2012 |
| GB | 717179 | A | 10/1954 |
| WO | WO-2009020397 | A1 | 2/2009 |
| WO | WO-2014081305 | | 5/2015 |

OTHER PUBLICATIONS

"Australian Application Serial No. 2012394996, Response filed Jul. 27, 2016 to First Examiner Report dated Dec. 2, 2015", 22 pgs.
"Canadian Application Serial No. 2,891,308, Office Action dated May 3, 2016", 4 pgs.
"International Application Serial No. PCT/NO2012/050235, International Search Report dated Jun. 25, 2013", 3 pgs.
"Australian Application Serial No. 2012394996, First Examiner Report dated Dec. 2, 2015", 3 pgs.
"European Application Serial No. 12888823.7, Office Action dated Sep. 8, 2015", 2 pgs.
"European Application Serial No. 12888823.7, Response filed Feb. 29, 2016 to Office Action dated Sep. 8, 2015", 8 pgs.
"International Application Serial No. PCT/NO2012/050235, International Preliminary Report on Patentability dated Jun. 4, 2015", 7 pgs.
"International Application Serial No. PCT/NO2012/050235, Written Opinion dated Jun. 25, 2013", 5 pgs.

* cited by examiner

WELL RUNNER

PRIORITY APPLICATIONS

This application is a U.S. National Stage Filing under U.S.C. §371 from International Application No. PTC/NO2012/050235, filed on 26 Nov. 2012, and published as WO/2014/081305 on 30 May 2014; which application and publication are incorporated herein by reference in their entirety.

TECHNICAL FIELD

The invention relates to a well runner for use in pipelines and boreholes for the production of oil and gas.

BACKGROUND OF THE INVENTION

In pipelines and boreholes having lengths of several km there is usually a need for conveying down different equipment and tools and/or collecting or acquisition of measured data or samples, etc. For those purposes pulling tools or well tractors having different embodiments are being used, wherein some have wheels or chains providing for axial rolling of the pulling tool or well tractor on the pipe or borehole wall. The roller(s) or the chain(s) is(are) being pressed against the pipe or borehole wall with a force that is sufficient for achieving the desired axial propulsive force in a number of varying frictional conditions. The power supply is commonly effected via a cable connection to the surface.

Most known pulling tools or well tractors utilize electric/hydraulic operation(s). This means that an electric motor drives a hydraulic pump, which again supplies power to the hydraulic motor(s) in the driving wheel(s). Such a system will be technically complex, and consequently low efficiency will be achieved. With a limited supply of power through long cable(s), the traction or propulsion force will be substantially limited. In several operations great tractive or propulsive force or power is desirable.

SUMMARY OF THE INVENTION

It is therefore an object of the invention to provide a substantially higher performance and/or efficiency for the well runner.

Another object of the invention is to meet, in a simple and robust way, the functional requirements for the well runner regarding handling of restrictions and sharp curvatures or other obstacles without getting stuck.

Yet another object of the invention is to overcome some of the disadvantages and drawbacks of the known prior art.

According to one aspect of the invention this is achieved with the help of a borehole or well tractor or runner as described and specified in this publication.

According to another aspect of the invention this is achieved with the help of a drive module for a well runner as described and specified in this publication.

A drive module for a borehole or well tractor or runner comprises a drive module housing and a hydraulically actuated and pivoting drive arm comprising an arm housing and a drive wheel arranged thereto, wherein the drive wheel is driven by a motor mounted outside the drive arm housing and arranged along and parallel with the drive arm in resting position and onto or into the drive module wall for the cavity arranged or provided for the drive arm, and wherein the drive wheel is drivingly connected to the motor via a drive line arrangement, i.e. via a belt or chain drive arrangement and further via an angular gear or gearing arrangement mounted outside the drive arm housing.

A borehole or well tractor or runner comprises at least one of said drive modules.

The angular gear or gearing arrangement of the drive line arrangement can be a bevel gear combined with a dual chain or belt drive arrangement. Alternatively, the drive line arrangement can comprise a bevel gear combined with a planetary gear and a single chain or belt drive arrangement.

The main features of this invention are given in the independent claims. Additional features of the present invention are given in the dependent claims.

BRIEF DESCRIPTION OF THE DRAWINGS

These and other aspects of the invention are apparent from and will be further elucidated, by way of example(s), with reference to the drawings, wherein.

DETAILED DESCRIPTION OF THE EMBODIMENTS

In the present invention the propulsion effect is provided without use of hydraulics. Thereby a substantially higher performance is achieved for the borehole or well tractor or runner.

A borehole or well tractor or runner should be designed to be able to negotiate different restrictions, sharp curvatures and/or other obstacles without getting stuck. In order to achieve these important or required functions, a solution has been provided in the present invention, thus making it possible to meet said functional requirements in a simple and robust way.

Figure 1:
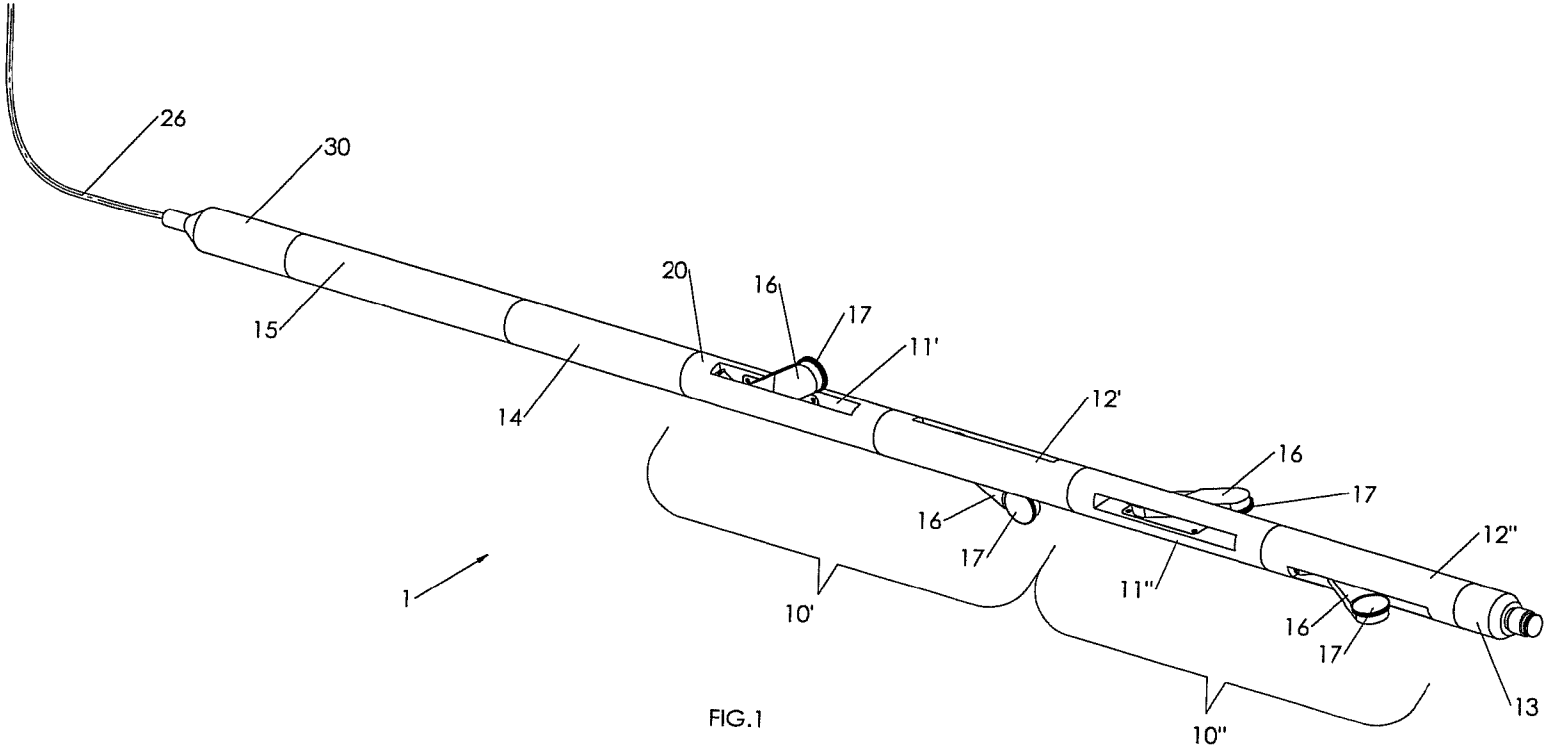
FIG. 1 shows in perspective one embodiment of a borehole or well tractor or runner according to the present invention.

FIG. 1 shows, in perspective, one embodiment of a borehole or well tractor or runner 1 according to the present invention. The well runner 1 comprises or is being divided in at least two units, wherein the well runner 1, and in particular each of its units, is provided with an outer housing 20. In this embodiment the well runner 1 is shown comprising two drive units 10', 10", one hydraulics unit 14, one electronic modules unit 15, a near or top side or end module unit 30 and a far or bottom side or end module unit 13, wherein the near or top side or end of the well runner 1 can be defined as the well runner 1 end being closer to the place where the well runner 1 entered the borehole or pipeline, than the other well runner 1 end, which is being defined as the far or bottom side or end of said well runner 1.

A tension sub (not shown) for cable tension monitoring can be positioned at the top end of well runner 1. This tension sub can be used to prevent the well runner 1 from running over the cable 26 during reverse operation. The tension sub can presumably be arranged or placed in the cable fastening point at top of the well runner 1, for example in the top side module unit, also called as (upper) UMT (user module top) 30.

Centralization module(s) can presumably be required in order to stabilize the well runner 1 at the center of a casing or pipe, and can presumably be arranged or placed as or in the top side module unit or UTM unit 30. With this construction/design it can be achieved that the well runner 1 should always be kept centered within a pipe or borehole or casing. This is a condition for allowing efficient positioning of equipment and/or operation of measuring tool(s), etc.

Each drive unit 10', 10" can comprise at least one drive module 11', 12', 11", 12", and in this embodiment of the well runner 1 each drive unit 10', respectively 10", comprises two drive modules 11', 12', respectively 11", 12". There can be for example up to four drive modules 11', 12', 11", 12" having drive arms in one drive unit or body 10', 10". Higher number (than four) of drive modules in one drive unit can also be possible. Higher number (than two) of drive units in the well runner can be possible too. Each drive unit 10', 10" can further comprise a motor controller or MC module (not shown).

One desired design of the well runner 1 comprises two drive units 10', respectively 10" having two drive modules 11', 12', respectively 11", 12", each with 90°, 180° and 270° degrees angle of one arm relative to other arms viewed in a section perpendicular to the longitudinal axis of the well runner 1. Of course, other suitable angles should be possible (e.g. 120 and 240 degrees offset from each other, etc.).

The electronic modules unit 15 can comprise at least one of: a power supply module, a telemetry module and a tractor or runner controller module.

The hydraulics unit 14 can be used for e.g. operating or actuating a hydraulic actuator, e.g. a hydraulic cylinder, providing for manipulating a drive wheel/arm of a drive module 11', 12', 11", 12". The hydraulics unit 14 can comprise a pressure compensation chamber against the well and a volume expansion chamber. Moreover, it comprises an electric motor and a pump as well as a valve system and (pressure) sensor(s) in order to operate and/or control the hydraulic actuation of each drive module arm 16. The motor, pump and valve system are being controlled e.g. electronically by a controller (unit) in the electrical or electronic module 15.

The far or bottom side or end module unit 13 can be used as an interface for payload module(s) that can be connected or coupled thereto, wherein a payload module is e.g., and not limited only to, a tool or equipment that is to be carried and operated in the well or pipe, such as e.g. anchors, actuators, mills/stampers, logging equipment, etc.

Several control systems and additional modules can be integrated in or connected to the well runner 1, when or if needed or necessary, in order to e.g. monitor different/various functions and/or operations of the well runner 1 and/or its units or elements.

The module and/or unit configuration shown in FIG. 1 is just an example of such, but however other module/unit configurations of the well runner 1 may be just as suitable.

Figure 2A:
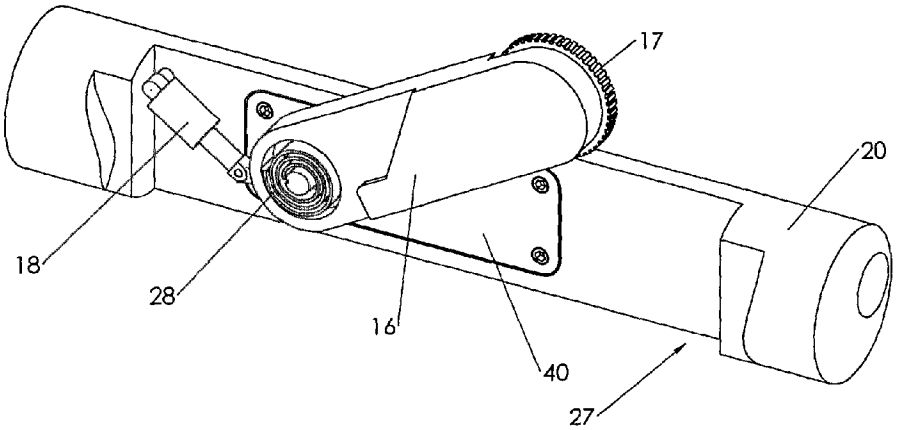
FIG. 2A-2C show different views and a cross section of an embodiment of a drive module for the borehole or well tractor or runner according to the present invention.
Figure 2B:
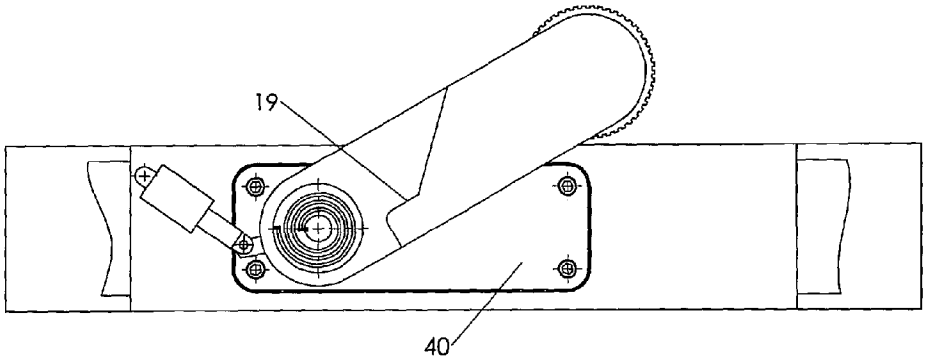
Figure 2C:
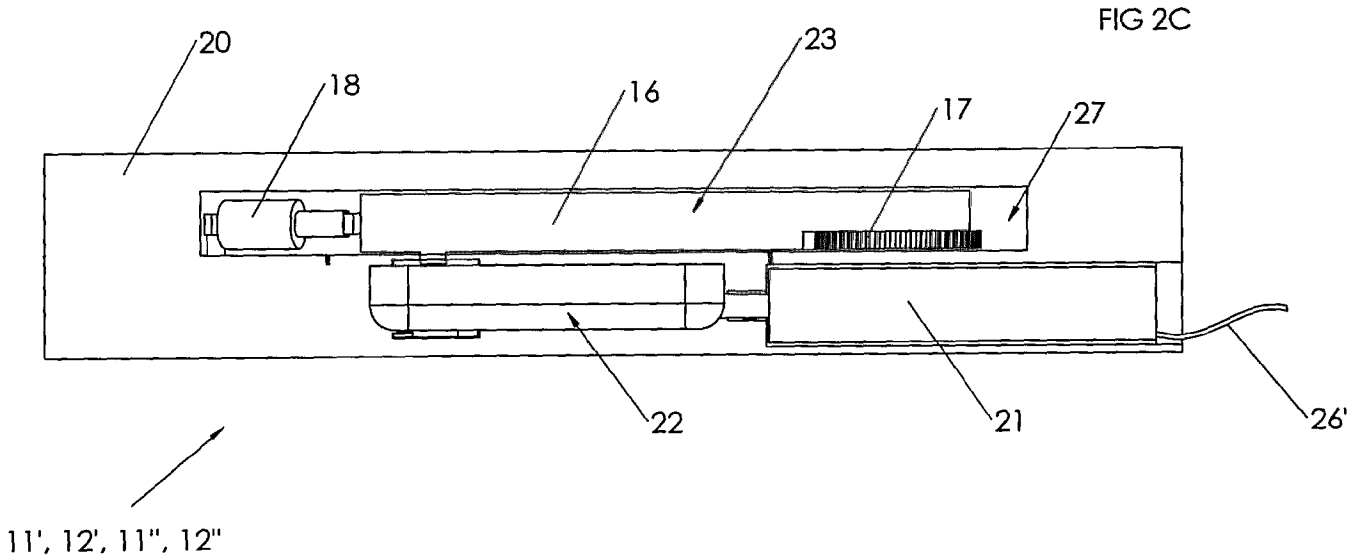

FIG. 2A-2C show different views and a cross section of an embodiment of a drive module 11', 12', 11", 12" for the borehole or well tractor or runner 1 according to the present invention.

Every drive module 11', 12', 11", 12" has individual propulsion with a determined maximum pulling or tractive force or power, based on the motor capacity and the friction between the drive wheel 17 and the pipe or casing wall (not shown). Hence, configuring a predetermined number of drive units 10', 10", respectively drive modules 11', 12', 11", 12", in series can provide the required or desired total propulsion force capacity for the well runner 1.

The drive module 11', 12', 11", 12" can move in both directions, wherein the drive wheel 17 moves in both directions of rotation with identical capacity and/or speed.

Every drive module 11', 12', 11", 12" comprises a motor 21, e.g. an electrical motor, a drive wheel 17 and a drive line arrangement 22, 23 between the motor 21 and the drive wheel 17. The drive wheel 17 and some parts of the drive line arrangement 22, 23 are installed on a drive arm 16 in order to enable variable distance relative to the rest of the drive module 11', 12', 11", 12", respectively the well runner 1, in order to reach the pipe or borehole or casing wall in which it is run.

The position of the drive wheel 17/arm 16 may be manipulated using an adjustable pressure hydraulic actuator 18, e.g. adjustable pressure hydraulic cylinder.

Each arm 16 can be individually activated or deactivated/returned to its closed or resting position, if needed (e.g. in case of malfunction in the drive line arrangement 22, 23 in a drive module 11', 12', 11", 12").

The arm's 16 pivoting linkages and the fastening point for the hydraulic cylinder's 18 position have a geometry that enables a relatively linear relation between the contact force from the drive wheel 17 on the casing or pipe and the corresponding hydraulic cylinder 18 pressure, valid for the entire reach of the drive wheel 17 relative to the drive module 11', 12', 11", 12" (which simplifies the control need for hydraulic pressure).

The drive wheel's 17 contact force on or against or towards the casing or pipe or borehole can then be adjusted in order to obtain a required or desired friction, simply by manipulating the cylinder 18 pressure. Further, a very simple traction control arrangement or system may be implemented based on obtaining the required or desired friction by defining the cylinder 18 pressure as a function of the operator-set pull or push force for the well tractor. A computing unit may be connected in order to auto-matically regulate the hydraulic pressure to the cylinder 18 based on the operator's pull or push force commands.

One possible design has a spring return function (clock spring) exerting continuous force on the arm 16, wherein the drive arm 16 can be hinged to a single acting hydraulic actuator 18 and a rotational retraction spring (not shown). An alternate design could be utilizing a double or dual acting hydraulic actuator 18, e.g. double or dual motion hydraulic cylinder, providing for the hydraulic operation of the drive arm 16. Both designs provide for returning the arm 16/drive wheel 17 in closed or resting position.

In order to control the drive wheel's 17 rotation, speed and position, every drive module 11', 12', 11", 12" can also comprise and/or utilize possible or required control components, means and/or systems, that all or partially can be arranged e.g. in the motor controller module.

Each drive wheel 17 and/or motor 21 can be controlled and operated independently. Despite that each drive module 11', 12', 11", 12" is mechanically independent of the other drive module(s), it can be possible or necessary to connect them together or make them communicate together in order to synchronize rotation, speed, position, torque, force or other characteristics for one drive wheel 17 with all the other drive wheels 17, for all installed drive modules 11', 12', 11", 12".

With reference numeral 40 in FIGS. 2A and 2B a cover 40 for the motor 21 and/or the drive line 22 being arranged on the housing 20 is shown.

A cavity 27 arranged or provided for the drive arm 16 and the drive wheel 17, when being in a resting position and being along and parallel with the motor 21 and the drive line 22 hidden by the cover 40, is shown on FIGS. 2A and 2C.

FIG. 3A-3D show different views of important drive line elements or components of the drive module 11', 12', 11", 12" for the borehole or well tractor or runner 1 according to the present invention.

A detailed description with respect to the drive line arrangement 22, 23 and the position of its components or elements will be given below.

Figure 3A:
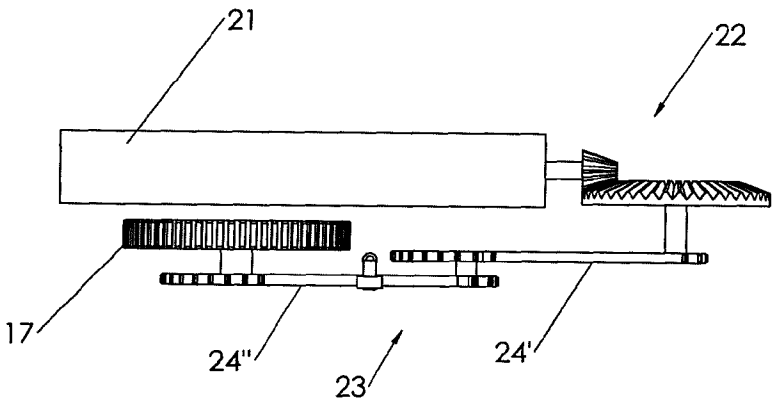
FIG. 3A-3D show different views of important drive line elements of the drive module for the borehole or well tractor or runner according to the present invention.
Figure 3B:
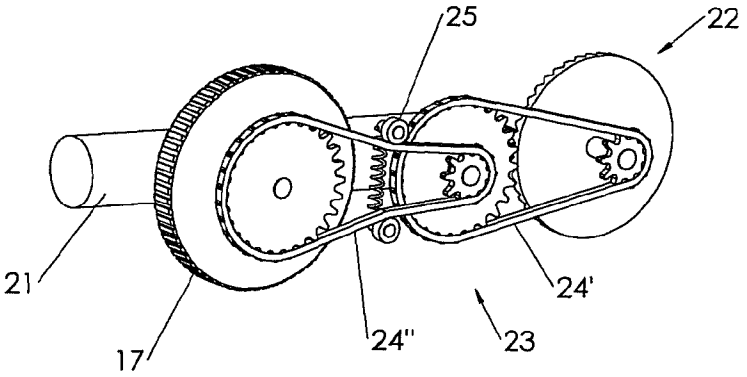
Figure 3C:
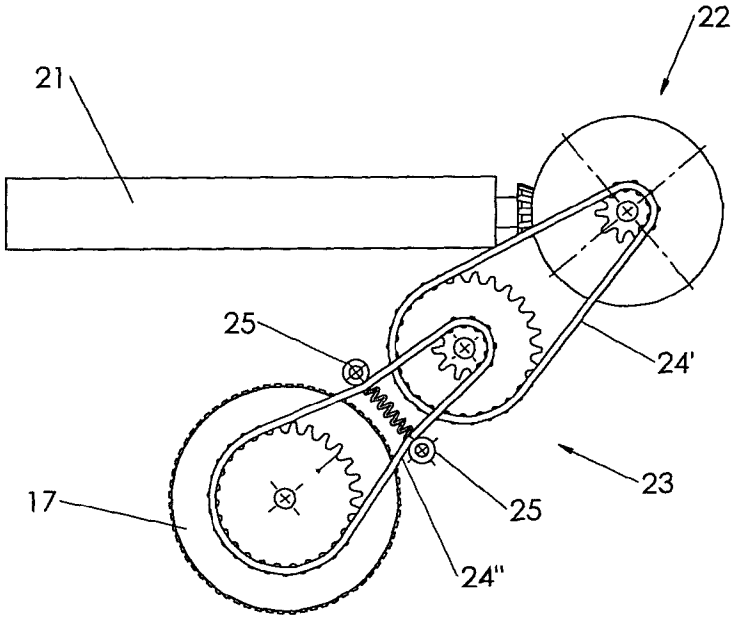
Figure 3D:
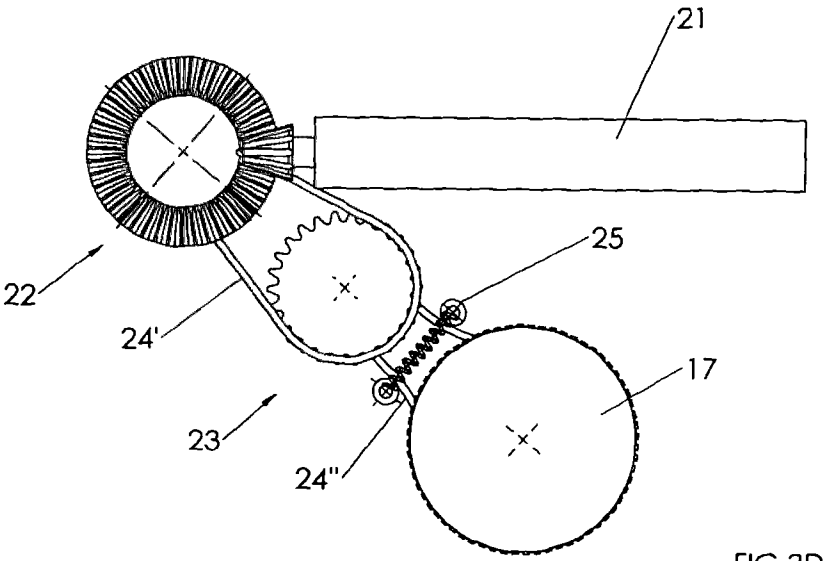

The motor 21 is arranged or installed outside the arm 16. In order to keep the longitudinal length of the drive module 11', 12', 11", 12" as short as possible, the motor 21 and the drive line 22 are installed parallel to the arm 16 in resting position (FIG. 3A).

The angular or bevel gear or gearing arrangement 22 can be an individual module in the drive line arrangement 22, 23.

The extending axle on or of the angular gear 22 has an identical center axis as the rotational (or tilt) axis of the (drive) arm 18.

In one possible design the motor 21 is connected to a drive wheel 17 with an angular gear 22 and two chains or belts 24', 24" connected in series. An alternative design could be replacing one of the chains or belts 24 with a planetary gear (not shown), on the same axle as the extending axle on the angular gear 22, in order to obtain desired gear ratio.

The shown chain or belt drive 23 has very low sensitivity to tolerances of the positioning of independent components (chain/belt parallelism, etc.) compared to e.g. gears, hence providing a robust system.

The motor 21, angular gear 22 and belt or chain housing (arm housing) 16 may all have individual and separate lubrication to prevent spreading pollution between them. All chambers can be pressure equalized with the surroundings by external pressure equalization chambers.

The chain/belt drive 23 comprises, as shown in FIG. 3A-3D, two chains or belts 24', 24" connected in series, where the shared axle for both drives are axially displaceable, such as shown chain tightening mechanism 25 can be utilized to tighten both chains or belts 24', 24".

The chain tightening mechanism 25 can also serve as a damper in the drive line arrangement 22, 23, so that impulses/shocks from the drive wheel 17 will be dampened before reaching the angular gear 22 and the motor 21.

The arm 16 with drive wheel 17 is being activated or rotated outwards from closed or resting position towards at least one expanded position by use of the hydraulic cylinder 18.

In one possible design the arm 16 can have a profile/contact surface 19 (on FIG. 2B) serving as a rotational stopper 19 for the arm 16 at maximal expansion/torsion of arm 16. The profile 19 of the arm 16 comes in contact with a corresponding profile on the drive module's 11', 12', 11", 12" body. The purpose of this stopper 19 is to simplify the hydraulic cylinder 18, so that the cylinder 18 itself will not need a stopper for securing its end outstretching or expansion, something that would require sufficient space. Thus the stopping or the end/outstretched position of the arm 16 is provided rather by the outstretching or swinging limitation of the arm 16 itself.

The geometric relations between the rotational axis for the arm 16 and the attachment points for the hydraulic cylinder 18 are chosen to as best as possible, so that at a fixed hydraulic pressure the force outwards on the drive wheel 17 will be kept constant across the entire range of the drive wheel 17 relative to the drive module 11', 12', 11", 12" (which simplifies the control need for hydraulic pressure).

The hydraulic system or cylinder 18 for arm 16 activation and/or control is made to enable deactivating (pulling in) of each arm 16 (e.g. one or more) independently without any need for deactivation of the other arms 16. Arm deactivation can be done, if e.g. a drive line 22, 23 problem for an arm is registered, or also if e.g. a special (changed) centralization of the well runner 1 in the well or pipe is desired or required. Such a function will be of significance when entering y-sections in/of the well or pipe. In a y-section a well tractor or runner should be able to change centering in order to enter or go further.

The hydraulic system or cylinder 18 for controlling the arm 16 activation and control can also control the arm's 16 (hence also the drive wheel's 17) force outward on the well or pipe wall, hence optimizing/adjusting this according to the present or current conditions (propulsion force, casing or pipe wall condition, drive wheel condition, etc.).

The motor 21 can be supplied with power through cable line 26 or a cable element 26' (FIG. 2C) of the cable line 26. The cable (line) or wireline 26 provides for supply of electric power and control and/or feedback signals to the running unit or tractor/well runner. The cable 26 is in addition used for pulling the running unit out of the well under normal conditions. Such wirelines (e-lines) come from many manufacturers and with various constructions and/or sizes having thus varying strength and electrical capacity (depending on the number of conductors and/or the cross-section of the conductors). Most challenging is a cable with a single conductor when communication must be provided over the electrical power supply for the operation of the running unit or well tractor/runner. In addition, there is of course a limitation on the power transmission capacity of a cable due to the conductor cross-section and/or length of the cable and the fact that there are limitations on the permitted voltage that is to be applied to the cable. That is why the efficiency of the well tractor or runner has a great practical significance. With the present low effective tractors, it is often necessary to cut or reduce the wireline length in order to be able to transfer the required electrical power, e.g. if there is an extra cable length to be cut or removed in accordance with the job or operational depth, where the problem will consequently be that a costly wireline or cable (line) has been damaged. This can be avoided by the higher efficiency of the well tractor or runner according to the present invention. It is possible to go deeper and use the capacity of the well runner or tractor according to the present invention without being constrained by the power transmission capacity.

The well runner 1 and its units or modules can have an elongated, cylindrical form.

Several steps of gearing ratio can be provided by the drive line arrangement 22, 23.

Additional modifications, alterations and adaptations of the present invention will suggest themselves to those skilled in the art without departing from the scope of the invention as expressed and stated in the following patent claims.

The invention claimed is:

1. Drive module for a well tractor, comprising:

a drive module housing defining a cavity therein, and a drive arm that is hydraulically actuated and pivoting into and out of the cavity, the drive arm comprising an arm housing and a drive wheel arranged thereto, wherein the drive wheel is driven by a motor mounted outside the drive arm housing and arranged along and parallel with the drive arm in resting position, and wherein the drive wheel is drivingly connected to the motor via a drive line arrangement comprising a belt or chain drive arrangement comprising two chains or belts connected in series, and an angular gear or gearing arrangement mounted outside the drive arm housing.

2. Drive module according to claim 1, further comprising a hydraulic actuator providing for manipulation of the drive arm thereof.

3. Drive module according to claim 1, wherein the angular gear or gearing arrangement comprises a bevel gear.

4. Drive module according to claim 3, wherein the chain or belt drive arrangement further comprises a tightening mechanism being utilized to tighten a chain or belt.

5. Drive module according to claim 4, wherein the tightening mechanism serves as a damper in the drive line arrangement, so that impulses or shocks from the drive wheel will be dampened before reaching the angular gear and the motor.

6. Drive module according to claim 1, wherein an extending axle on the angular gear has an identical center axis as the rotational or tilt axis of the drive arm.

7. Drive module according to claim 1, wherein the belt or chain drive arrangement is arranged within the drive arm housing.

8. Drive module according to claim 1, wherein the drive line arrangement provides for several steps of gearing ratio.

9. Drive module according to claim 1, further comprising a traction control arrangement, wherein the contact force of the drive wheel against the casing or pipe or borehole is adjustable, for obtaining a required or desired friction, by manipulating a hydraulic pressure to a cylinder operably coupled to the drive arm as a function of a pull or push force set by an operator.

10. Drive module according to claim 9, wherein a computing unit regulates the hydraulic pressure to the cylinder based on the operator's pull or push force commands.

11. A well tractor, comprising at least one drive unit comprising:

at least one drive module, the drive module comprising, a drive module housing defining a cavity therein, and a drive arm that is hydraulically actuated and pivoting into and out of the cavity, the drive arm comprising an arm housing and a drive wheel arranged thereto, wherein the drive wheel is driven by a motor mounted outside the drive arm housing and arranged along and parallel with the drive arm in a resting position and onto or into the drive module wall for the cavity arranged or provided for the drive arm, and wherein the drive wheel is drivingly connected to the motor via a drive line arrangement comprising a belt or chain drive arrangement comprising two chains or belts connected in series, and an angular gear or gearing arrangement mounted outside the drive arm housing.

12. A well tractor according to claim 11, further comprising at least one of: a hydraulics unit, an electronic modules unit, a near or top side or end module unit and a bottom side module unit.

13. A well tractor according to claim 11, wherein the electronic modules unit comprises at least one of: a power supply module, a telemetry module and a tractor controller module.

14. A well tractor according to claim 12, wherein the hydraulics unit is operably coupled to a hydraulic actuator for manipulating the drive arm of the drive module.

15. A well tractor according to claim 11, further comprising a second drive module, comprising, a second drive module housing defining a second cavity therein, and a second drive arm that is hydraulically actuated and pivoting into and out of the second cavity, the second drive arm comprising a second drive arm housing and a second drive wheel arranged thereto, wherein the second drive wheel is driven by a second motor mounted outside the second drive arm housing and arranged along and parallel with the second drive arm in a resting position and onto or into the second drive module wall for the cavity provided for the second drive arm, and wherein the second drive wheel is drivingly connected to the second motor via a drive line arrangement comprising a belt or chain drive arrangement and an angular gear or gearing arrangement mounted outside the second drive arm housing;

wherein the first and second drive wheels are controlled and operated independently from one another.

16. A well tractor according to claim 15, wherein all installed mechanically independent drive modules communicate together in order to synchronize rotation, speed, position, torque or other characteristics for one drive wheel with all the other drive wheels thereof.

17. A well tractor according to claim 15, wherein all drive arms in the drive modules of the drive units have a predetermined angle or degree offset from each other, viewed in a section perpendicular to the longitudinal axis of the well runner.

18. A well tractor according to claim 15, wherein the second drive arm is individually activated or deactivated relative to the arm of any other drive module.

* * * * *